United States Patent [19]

Krause

[11] Patent Number: 4,610,277

[45] Date of Patent: Sep. 9, 1986

[54] COUNTERBALANCED LAY MOTION FOR HIGH SPEED WEAVING LOOMS

[75] Inventor: Alvan A. Krause, Greensboro, N.C.

[73] Assignee: Draper Corporation, Greensboro, N.C.

[21] Appl. No.: 723,485

[22] Filed: Apr. 15, 1985

[51] Int. Cl.[4] ..... D03D 49/60
[52] U.S. Cl. ..... 139/191
[58] Field of Search ..... 139/188 R, 190, 191

[56] References Cited

U.S. PATENT DOCUMENTS 3,127,912 4/1964 Mosher ..... 139/191

FOREIGN PATENT DOCUMENTS 3325591 12/1983 Fed. Rep. of Germany ..... 139/190
48-2590 1/1973 Japan ..... 139/190

*Primary Examiner*—Henry S. Jaudon
*Attorney, Agent, or Firm*—Charles R. Rhodes; Judith E. Garmon

[57] ABSTRACT

A counterweight is attached to the rocker shaft of a short sword loom diametrically opposite the lay, reed, and weft directing components to shift the center of gravity of the oscillatory elements to a position subtantially coincident with the center of gravity with a minimum of structural changes to the conventional loom configuration.

4 Claims, 3 Drawing Figures

COUNTERBALANCED LAY MOTION FOR HIGH SPEED WEAVING LOOMS

BACKGROUND AND SUMMARY OF THE PRESENT INVENTION

This invention relates generally to high speed weaving looms, and particularly to weaving looms which are operated at speeds in the range of at least 400 picks per minute and an improvement thereto which is directed to the elimination or minimization of the troublesome vibrations occurring therein.

There has been developed in recent years high speed weaving looms of the type which incorporate the "short sword system." The term "short sword system" refers to a loom in which the rocker shaft about which the lay or lay plate is oscillated in close proximity to the lay itself and the main crankshaft of the loom. Thus, the axis about which the lay rocks is considerably closer to the lay than is the case in the "long sword system" in which the axis about which the lay oscillates is near the floor.

The short sword system development which was developed primarily to increase speeds also results in some reduction in the vibrations attendant to the oscillatory movement of the lay when a longer pivot arm is utilized. However, because of the extremely high speeds of the mass of the lay oscillating about the rocker shaft, there are still generated undesirable and, in fact unacceptable, vibrations.

Vibrations caused by the reciprocatory movement of the lay in general, have been recognized in the prior art. For example, attempts to reduce such vibrations by utilizing counterbalancing concepts are disclosed in U.S. Pat. No. 4,076,048 to Bolleter et al and U.S. Pat. No. 3,955,603 to Martelli. The simplest approach to counterbalancing the effects of an oscillating mass on a moment arm is to apply an identical mass on an opposite moment arm. The counterbalancing approach disclosed and described in the Martelli U.S. Pat. No. 3,955,603 is in the environment of a long sword system. As there is no clearance room beneath the axis of rotation, a different approach had to be adopted. Thus, in Martelli the connecting rod which extends between the main crankshaft and the rocker shaft is elongated and a mass is added to the end of the connecting rod on the opposite side of the crankshaft from the rocker shaft. While this may help some, the mass, so located, is really not in the proper location to fully offset the vibrations.

The approach described in the Bolleter et al U.S. Pat. No. 4,076,048, while utilized on a short sword system, involves substantially a re-design of the rocker shaft. The redesign approach was adopted, because Bolleter et al was attempting to incorporate an offsetting mass without any additional weight being added which would result in greater energy usage. In order to accomplish this goal, first of all, the Bolleter rocker shaft is separated into several separate, colinear shaft portions which are each coupled to the main shaft by a cam follower, so that the shaft portions reciprocate. The shaft portions are then connected to a balance weight in the form of another weighted shaft portion(s) by a plurality of spaced coupling members. A lever, which surrounds the rocker shaft then supports the lay in the proper position, so that as the rocker shaft reciprocates, it causes the balance weight shaft to reciprocate in an arcuate path below and the lay to reciprocate in an arcuate path thereabove. While this may be somewhat effective, it is tremendously expensive to implement, introduces complicating factors to conventional lay oscillatory theories, and from a practiced standpoint, cannot be introduced as a retrofit for existing installations.

By comparison, and in accordance with the present invention, the undesirable vibrations are eliminated, or at least minimized, by means of a simple counterweight which is suspended from each end of the rocker shaft of conventional high speed, short sword loom systems diametrically opposite the lay. The counterweight is of such size and is so positioned as to shift the center of gravity of the oscillatory elements to a position substantially coincident with the center of gravity of the rocker shaft with a minimum of structural changes to the conventional loom configuration. This approach can be incorporated as a retrofit for existing installations, and more importantly, has been found to be completely satisfactory in substantially eliminating all vibrations in high speed looms, even air jet looms.

More specifically, a steel, lead, or other heavy metallic plate is suspended beneath each end of the rocker shaft, each of such plates being supported by two or more suspension brackets. Thus, the weight is positioned in the appropriate location to most effectively offset the vibrations which normally occur as a result of the oscillatory motion of the lay the reed, and such weft directing components as may be mounted on the lay plate as auxiliary air nozzles and the like. The counterbalancing effect of the present invention is achieved in the simplest, and thus the most efficient manner conceivable.

It is therefore an object of the present invention to nullify to the maximum extent possible the undesirable, oscillating lay induced vibrations occurring in a short sword weaving loom in the simplest and most expeditious manner possible.

It is another object of the present invention to minimize or nullify vibrations of the type described by suspending an equal and offsetting counterbalance on the opposite side of the rocker shaft axis from the vibration creating components which include the lay, loom reed, and weft directing components.

Other objects and a fuller understanding of the invention will become apparent from reading the following detailed description of a preferred embodiment along with the accompanying drawings in which.

DETAILED DESCRIPTION OF A PREFERRED EMBODIMENT

Figure 1:
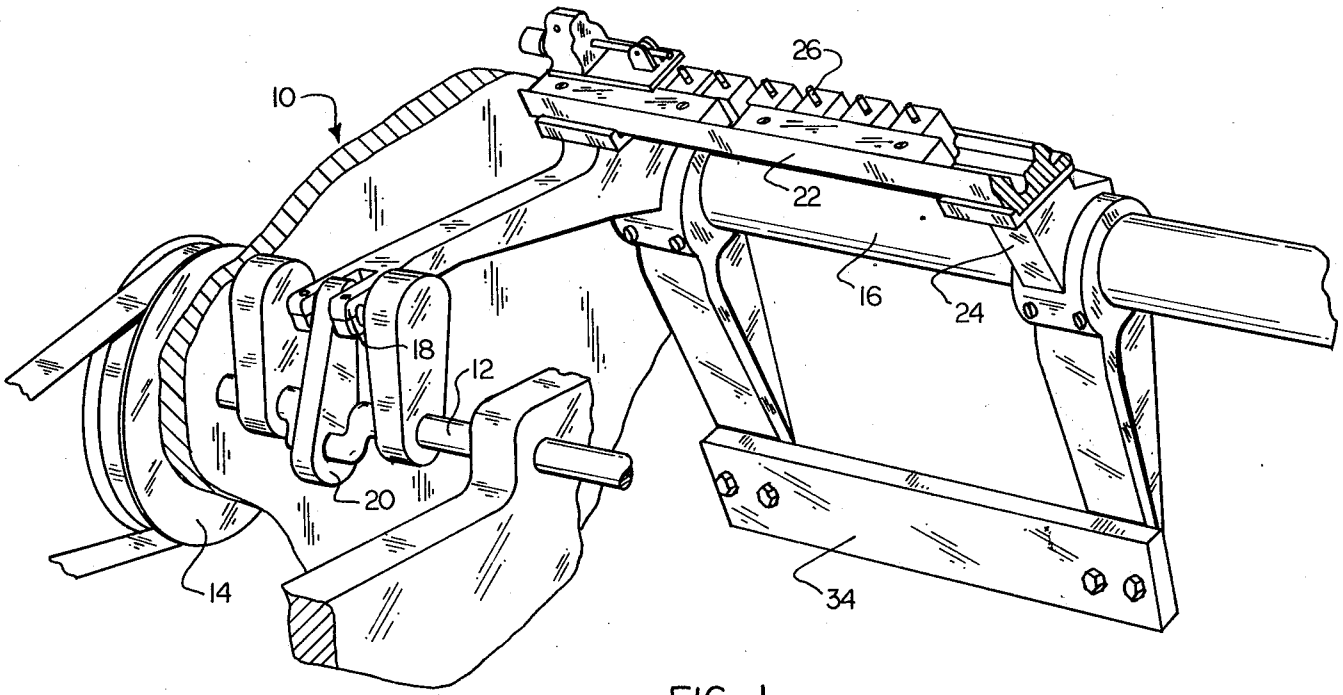
FIG. 1 is a perspective view with parts removed for the sake of clarity, of a weaving loom having the improvements of the present invention incorporated therein.
Figure 2:
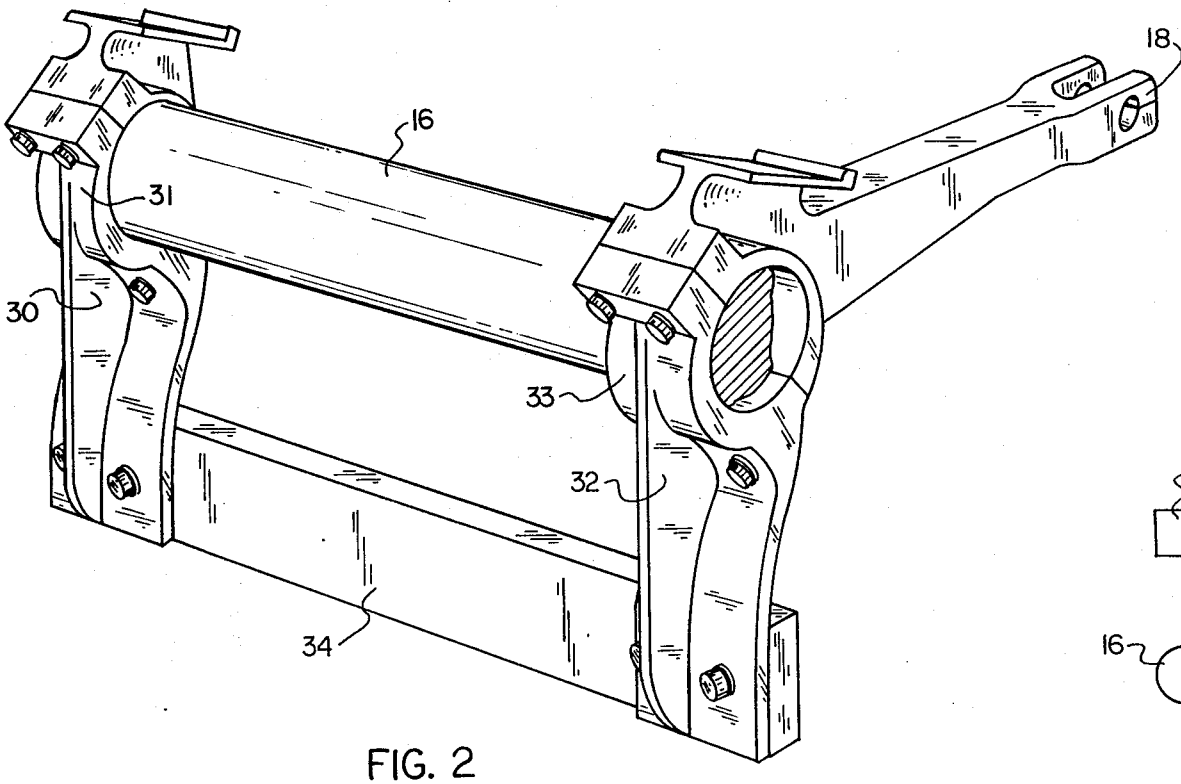
FIG. 2 is a perspective view of a portion of the rocker shaft of the weaving loom illustrating the counterbalance of the present invention and the manner in which it is suspended therefrom.

Turning now to the drawings, and particularly to FIGS. 1 and 2, there is illustrated a "short sword" high speed loom, such as for example an air jet loom 10 which includes a main shaft 12 operated by a pulley 14, which is connected to the output shaft of the loom's main motor, and a rocker shaft 16. The rocker shaft 16 includes a pair of end drive brackets 18 which extend radially therefrom to a position overlying main shaft 12. An operating rod 20 pivotally attached to each end bracket 18 extends downwardly to a point of connection with a U-shaped drive portion of the main shaft 12 to complete the coupling of rocker shaft 16 thereto. As the main shaft 12 is caused to rotate, there is imparted to the operating rod 20 a reciprocatory movement which is transferred to rocker shaft 16. Thus, rocker shaft 16 is caused to oscillate backwards and forwards in an arcuate path.

The lay 22 extends longitudinally above the rocker shaft and is connected thereto by a plurality of supporting brackets 24. So arranged, as the rocker shaft 16 oscillates, the lay is also caused to oscillate back and forth in a well known manner. A plurality of auxiliary air nozzles 26 extend along the lay to help or facilitate the movement of the weft thread through the warp shed in a well-known manner. A loom reed 27 is secured in the lay plate 22 for maintaining separation of the warp yarns and provide the conventional beat-up motion to the fabric being formed. The combined mass and moment arm of the lay 22, the reed 27, the auxiliary air nozzles 26, and the support brackets 24 have a resultant center of gravity at some point above the axis of the rocket shaft 16 which causes vibrations to occur as the rocker shaft oscillates at high speeds. Obviously, if the loom is operating at 400 picks per minute, the reed must make 400 oscillations per minute. The arcuate movement of these combined masses having a center of gravity removed from the axis of rocker shaft 16 then causes vibrations, the nullification of which is the primary object of the present invention.

Turning now to FIG. 2 there is illustrated a pair of mounting brackets 30,32 which comprise collars 31,33 surrounding rocker shaft 16 from which brackets 30,32 are suspended. A metallic plate 34 of such material as steel or lead is connected between the terminal portions of brackets 30,32.

A pair of brackets 30,32 which support the counterbalancing mass 34 therebetween is attached to either end of rocker shaft 16. By selecting the weight of plate 34 carefully, the center of gravity of the combined components which are oscillating about the axis of rocker shaft 16 may be returned to the longitudinal axis of rocker shaft 16, thus nullifying the undesirable vibrations which would normally occur.

Figure 3:
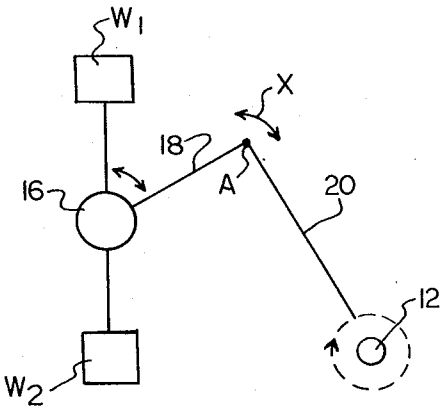
FIG. 3 is a mechanical schematic view illustrative of the concept of the present invention.

Looking now at the schematic representation of FIG. 3, the rotary motion of main shaft 12 imparts a linear reciprocatory movement to the connecting rod 20 and thus point A is caused to reciprocate back and forth in the direction illustrated by arrow x. This reciprocatory movement of point A imparts an oscillating arcuate movement to the rocker shaft 16 about the longitudinal axis thereof. The combined weights of the lay plate, the reed, the auxiliary air nozzles, and the support brackets are represented by the weight $W_1$, the center of gravity of which is removed from the longitudinal axis of rocker shaft 16. By introducing a selected mass or weight $W_2$ at a selected position from the longitudinal axis of rocker shaft 16 on the other side of weight $W_1$, the center of gravity of the combined weights $W_1$,$W_2$ may be returned to the longitudinal axis of rocker shaft 16. While a preferred embodiment of the present invention has been described in detail hereinabove, it is apparent that certain changes and modifications might be made without departing from the scope of the invention. For example, while an air jet loom has been described the invention is also applicable to other high speed looms, such as rapier or shuttleless looms. The scope of the invention then should be determined as set forth in the accompanying claims.

What is claimed is:

1. In a high speed weaving loom of the type which includes an oscillating rocker shaft, a lay attached to and extending upwardly from said rocker shaft along substantially the entire length thereof in spaced parallel arrangement thereto, and a coupling means connecting the main crankshaft of said loom with said lay for imparting a reciprocatory oscillating motion thereto about the axis of said rocker shaft, the improvement comprising a counterbalance means suspended by brackets from said rocker shaft at points axially spaced therealong and in spaced parallel arrangement to the axis of said rocker shaft, and brackets being so attached to said rocker shaft as to connect said counterbalance means in fixed, nonrotatable relation with respect to and substantially diametrically opposite said lay, said counterbalance means being of such size and so connected to the rocker shaft that the center of gravity of the lay, reed, counterbalance means, and all other components that reciprocatorily oscillate about the axis of said rocker shaft lie substantially on the axis of rotation of said rocker shaft, whereby vibrations normally transmitted to the loom are minimized.

2. The improvement in high speed weaving looms according to claim 1 wherein said brackets from which said counterbalance means are suspended also support, at least partially, said lay.

3. The improvement in high speed weaving looms according to claim 2 wherein said brackets comprise a cylindrical sleeve member attached to said rocker shaft, arm means depending from said sleeve to which said metallic plates are attached, and a support bracket upstanding from said cylindrical sleeve for supporting said lay.

4. The improvement in high speed weaving looms according to claim 1 wherein said counterbalance means comprise a pair of elongated metallic plates suspended in spaced parallel arrangement to the axis of said rocker shaft at points axially spaced therealong.

* * * * *